US009752441B2

(12) United States Patent
Hildebrand et al.

(10) Patent No.: US 9,752,441 B2
(45) Date of Patent: Sep. 5, 2017

(54) GAS TURBINE ROTARY BLADE WITH TIP INSERT

(75) Inventors: Gregory C. Hildebrand, Middletown, CT (US); James O. Hansen, Glastonbury, CT (US); Joseph Parkos, Jr., East Haddam, CT (US); Michael A. Weisse, Tolland, CT (US); Christopher J. Hertel, Wethersfield, CT (US); Jesse Meyer, Colchester, CT (US)

(73) Assignee: United Technologies Corporation, Farmington, CT (US)

( * ) Notice: Subject to any disclaimer, the term of this patent is extended or adjusted under 35 U.S.C. 154(b) by 636 days.

(21) Appl. No.: 13/362,968

(22) Filed: Jan. 31, 2012

(65) Prior Publication Data

US 2013/0195633 A1 Aug. 1, 2013

(51) Int. Cl.
*F01D 5/20* (2006.01)
*F01D 11/12* (2006.01)

(52) U.S. Cl.
CPC ..... *F01D 5/20* (2013.01); *F01D 11/122* (2013.01); *F05D 2220/36* (2013.01); *F05D 2240/307* (2013.01)

(58) Field of Classification Search
CPC ... F01D 5/20; F01D 5/28; F01D 5/284; F01D 11/125; F01D 11/127; F01D 11/12; F01D 11/08; F01D 11/122; F05D 2240/307
USPC ..... 415/9, 173.4, 173.5; 416/224, 190–192
See application file for complete search history.

(56) References Cited

U.S. PATENT DOCUMENTS

| | | | | |
|---|---|---|---|---|
| 3,117,716 | A | 1/1964 | Wernicke | |
| 4,006,999 | A | 2/1977 | Brantley et al. | |
| 4,022,547 | A | 5/1977 | Stanley | |
| 4,051,289 | A | 9/1977 | Adamson | |
| 4,118,147 | A | 10/1978 | Ellis | |
| 4,285,634 | A | 8/1981 | Rossman et al. | |
| 4,854,196 | A | 8/1989 | Mehan | |
| 5,253,976 | A | 10/1993 | Cunha | |
| 5,363,554 | A * | 11/1994 | Partridge | B23K 20/023 29/889.1 |
| 5,476,363 | A | 12/1995 | Freling et al. | |
| 5,547,769 | A | 8/1996 | Schmitz | |

(Continued)

FOREIGN PATENT DOCUMENTS

| | | |
|---|---|---|
| DE | 193192 | 12/1907 |
| DE | 19824583 | 9/1999 |

(Continued)

OTHER PUBLICATIONS

International search report for PCT/US13/024117 dated May 15, 2013.
EP search report for EP13743738.0 dated Oct. 1, 2015.

*Primary Examiner* — Ninh H Nguyen
*Assistant Examiner* — Brian P Wolcott
(74) *Attorney, Agent, or Firm* — O'Shea Getz P.C.

(57) ABSTRACT

A rotary blade is provided that includes a root, an airfoil, and a tip insert. The airfoil is attached to the root, and has a suction side surface, a pressure side surface, a leading edge, a trailing edge, a tip, and a slot disposed within the tip. The slot extends in a chordwise direction between the leading edge and trailing edge. The tip insert has a base end and a rub end. The base end of the tip insert is disposed within the slot. The rub end of the tip insert extends radially outward from the airfoil tip.

19 Claims, 3 Drawing Sheets

(56) References Cited

U.S. PATENT DOCUMENTS

| | | | | |
|---|---|---|---|---|
| 5,603,603 | A | 2/1997 | Benoit et al. | |
| 5,785,498 | A | 7/1998 | Quinn et al. | |
| 6,206,642 | B1 * | 3/2001 | Matheny et al. | 416/230 |
| 6,413,051 | B1 | 7/2002 | Chou et al. | |
| 6,478,537 | B2 | 11/2002 | Junkin | |
| 6,607,358 | B2 * | 8/2003 | Finn et al. | 416/224 |
| 6,619,913 | B2 * | 9/2003 | Czachor et al. | 415/119 |
| 6,648,596 | B1 | 11/2003 | Grylls et al. | |
| 7,419,363 | B2 | 9/2008 | Downs | |
| 7,604,455 | B2 | 10/2009 | Paprotna et al. | |
| 7,780,419 | B1 * | 8/2010 | Matheny | F01D 5/005 416/221 |
| 7,789,630 | B2 | 9/2010 | Schilling et al. | |
| 7,837,446 | B2 * | 11/2010 | McMillan | 416/224 |
| 7,841,834 | B1 | 11/2010 | Ryznic | |
| 7,993,105 | B2 | 8/2011 | Weisse et al. | |
| 9,085,989 | B2 | 7/2015 | Shah et al. | |
| 2003/0071019 | A1 | 4/2003 | Cline et al. | |
| 2003/0129061 | A1 | 7/2003 | Finn et al. | |
| 2005/0091848 | A1 | 5/2005 | Nenov et al. | |
| 2005/0175447 | A1 * | 8/2005 | Garner | 415/173.3 |
| 2007/0092378 | A1 | 4/2007 | Tudor | |
| 2007/0258825 | A1 | 11/2007 | Shadbolt et al. | |
| 2009/0053070 | A1 | 2/2009 | Schilling | |
| 2009/0185903 | A1 | 7/2009 | Beeck et al. | |
| 2010/0290920 | A1 * | 11/2010 | Liang | 416/97 R |
| 2010/0296939 | A1 | 11/2010 | Jevons | |
| 2010/0329875 | A1 | 12/2010 | Kray et al. | |
| 2011/0038732 | A1 | 2/2011 | Huth et al. | |
| 2011/0052405 | A1 | 3/2011 | Parkin | |
| 2011/0138769 | A1 | 6/2011 | Costa et al. | |
| 2011/0194941 | A1 | 8/2011 | Parkin et al. | |

FOREIGN PATENT DOCUMENTS

| | | | | |
|---|---|---|---|---|
| DE | 19824583 | A1 * | 12/1999 | C23C 4/00 |
| DE | 102004050739 | | 4/2006 | |
| DE | 102004050739 | B4 * | 6/2006 | F01D 5/20 |
| EP | 1640562 | A1 | 3/2006 | |
| JP | 62142805 | | 6/1987 | |
| WO | WO 0226015 | A2 * | 4/2002 | |

* cited by examiner

GAS TURBINE ROTARY BLADE WITH TIP INSERT

BACKGROUND OF THE INVENTION

1. Technical Field

The present invention relates to rotary blade assemblies for gas turbine engines in general, and to rotary blade tip structures in particular.

2. Background Information

Gas turbine engines are typically designed to minimize the clearance between rotary blade tips and the surrounding casing. Such designs decrease air leakage between the blade tips and the casing, and thereby improve the efficiency of the engine. Some prior art designs include an abradable material disposed on an interior portion of the casing surrounding the rotary blade tips. During initial use of such prior art designs, the rotary blades extend radially outward and engage the abradable material, creating a trench within the abradable material. During subsequent use of such prior art designs, the rotary blade tips extend into the trench and thereby create a decreased leakage air path between the rotary blade tips and the abradable seal. These designs work reasonably well, but can also have drawbacks relating to mechanical durability of the blade tips. For example, prior art rotary blades made of durable materials (i.e., materials sufficiently durable to prevent blade tip failure) often make the rotary blade undesirably heavy. Another prior art attempt to solve blade tip durability involved anodizing rotary blade tips to strengthen them. This approach can be problematic because the anodizing can cause cracking in the fan blade.

What is needed, therefore, are rotary blades for use in gas turbine engines, which blades are sufficiently durable so as to prevent the blade tips from being damaged if they engage an abradable seal material, and which rotary blades overcome the problems discussed above.

SUMMARY OF THE INVENTION

According to one aspect of the present invention, a rotary blade is provided that includes a root, an airfoil, and a tip insert. The airfoil is attached to the root, and has a suction side surface, a pressure side surface, a leading edge, a trailing edge, a tip, and a slot disposed within the tip. The slot extends in a chordwise direction between the leading edge and trailing edge. The tip insert has a base end and a rub end. The base end of the tip insert is disposed within the slot. The rub end of the tip insert extends radially outward from the airfoil tip.

In a further embodiment of any of the foregoing embodiments, the slot is disposed in the tip between the pressure side surface and the suction side surface of the airfoil.

In a further embodiment of any of the foregoing embodiments, a portion of the slot extends to the pressure side surface of the blade adjacent to the trailing edge portion of the blade.

In a further embodiment of any of the foregoing embodiments, the slot extends all the way between the leading edge and the trailing edge.

In a further embodiment of any of the foregoing embodiments, a leading edge insert is disposed at the leading edge of the blade.

In a further embodiment of any of the foregoing embodiments, the leading edge insert extends chordwise along a first portion of the tip, and the tip insert extends chordwise along a second portion of the tip, and the sum of the first portion and the second portion is equal to or greater than a chordlength of the airfoil tip.

In a further embodiment of any of the foregoing embodiments, the airfoil comprises aluminum, and the tip insert comprises anodized aluminum, titanium and/or ceramic.

In a further embodiment of any of the foregoing embodiments, the slot is substantially rectangular-shaped.

In a further embodiment of any of the foregoing embodiments, at least a portion of the slot is arcuately shaped.

According to another aspect of the present invention, a rotary blade tip insert for a rotary blade having an airfoil that has a suction side surface, a pressure side surface, a leading edge, a trailing edge, a tip, and a slot disposed within the tip, is provided. The tip insert has a width extending between a base end and a rub end, and a length extending between a forward end and an aft end. The base end is configured to be received within the slot and the rub end is configured to extend radially outward from the airfoil tip.

In a further embodiment of any of the foregoing embodiments, the length of the tip insert is substantially equal to the chordwise distance between the leading edge and the trailing edge of the airfoil.

In a further embodiment of any of the foregoing embodiments, the tip insert comprises anodized aluminum, titanium and/or ceramic.

In a further embodiment of any of the foregoing embodiments, the widthwise cross-section of the tip insert is substantially rectangular-shaped.

In a further embodiment of any of the foregoing embodiments, at least a portion of the width-wise cross-section of the tip insert is arcuately shaped.

According to another aspect of the present invention, a rotary blade assembly within a gas turbine engine is provided. The assembly includes a plurality of rotary blades extending radially outwardly from a hub, and a containment case. Each rotary blade has an airfoil that has a suction side surface, a pressure side surface, a leading edge, a trailing edge, a tip, and a slot disposed within the tip. Each rotary blade further includes a tip insert having a base end and a rub end. The base end of the tip insert is disposed within the slot. The rub end of the tip insert extends radially outward from the airfoil tip. The containment case is disposed radially outside of the rotary blades and circumferentially surrounding the plurality of blades.

In a further embodiment of any of the foregoing embodiments, the plurality of rotary blades are fan blades.

In a further embodiment of any of the foregoing embodiments, the airfoil comprises aluminum, and the tip insert comprises anodized aluminum, titanium and/or ceramic.

In a further embodiment of any of the foregoing embodiments, the slot in each of the plurality of rotary blades is at least partially arcuately shaped.

The foregoing features and advantages and the operation of the invention will become more apparent in light of the following description of the best mode for carrying out the invention and the accompanying drawings.

DETAILED DESCRIPTION OF THE INVENTION

Figure 1:
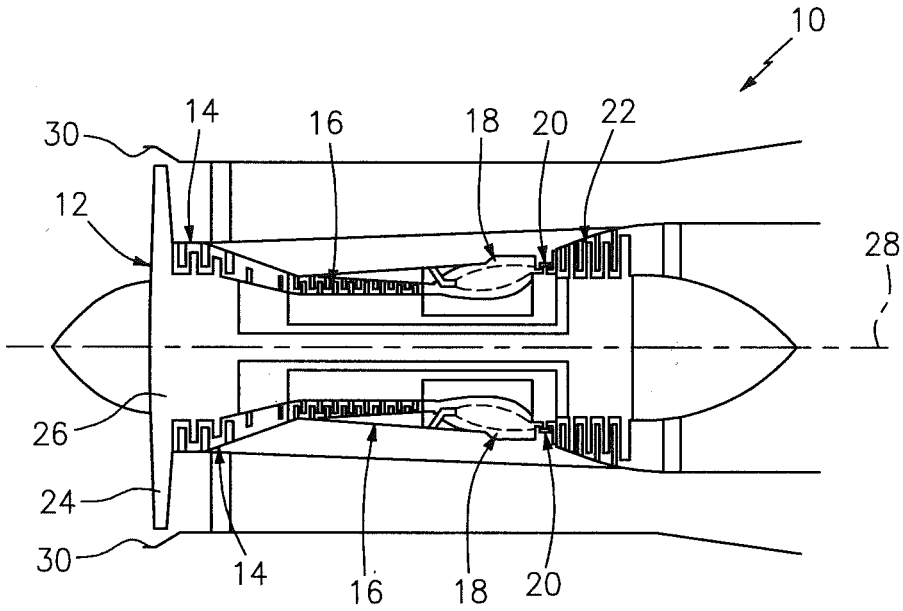
FIG. 1 is a diagrammatic cross-sectional illustration of one embodiment of a gas turbine engine.
Figure 2:
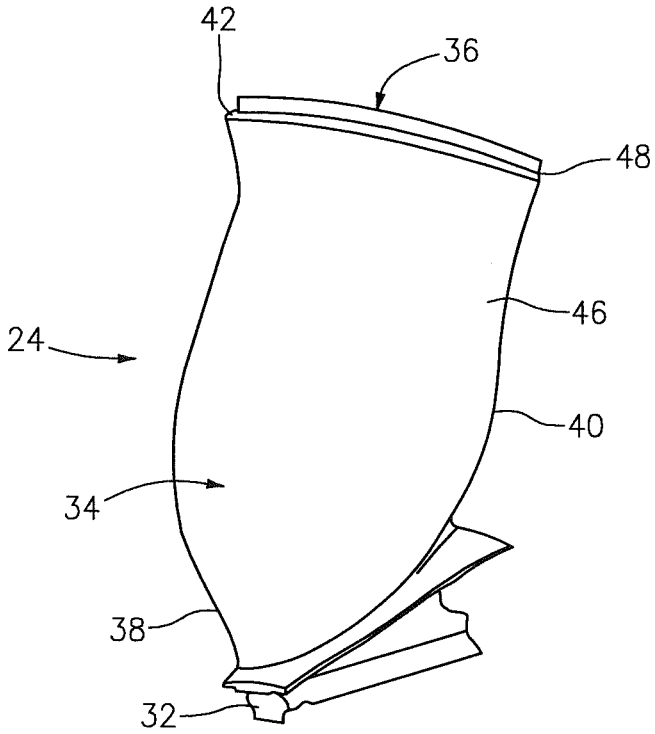
FIG. 2 is a perspective view of a present invention rotary blade embodiment; e.g., a fan blade.
Figure 3:
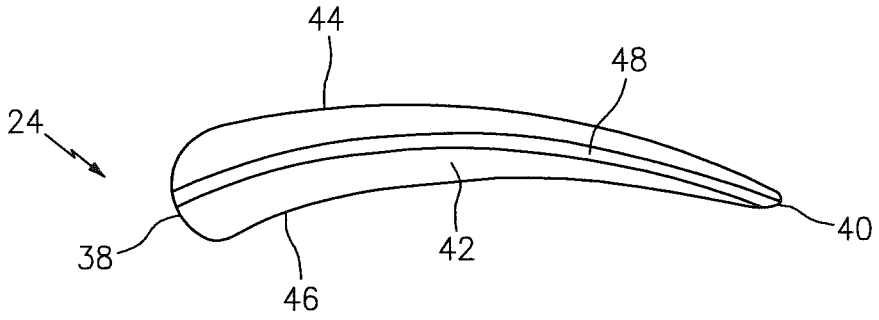
FIG. 3 is a diagrammatic top view of a blade tip and tip insert embodiment.
Figure 4:
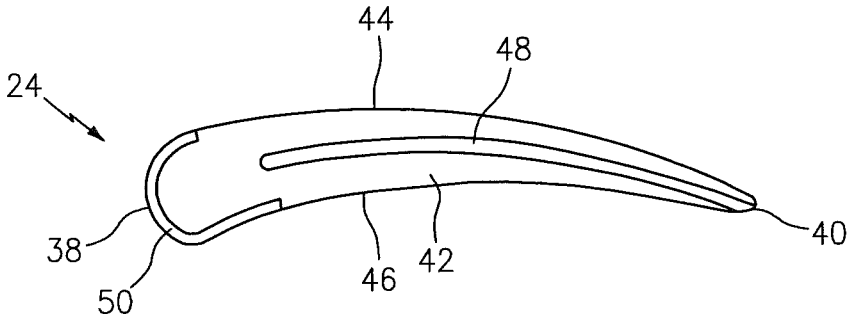
FIG. 4 is a diagrammatic top view of a blade tip and tip insert embodiment.
Figure 5:
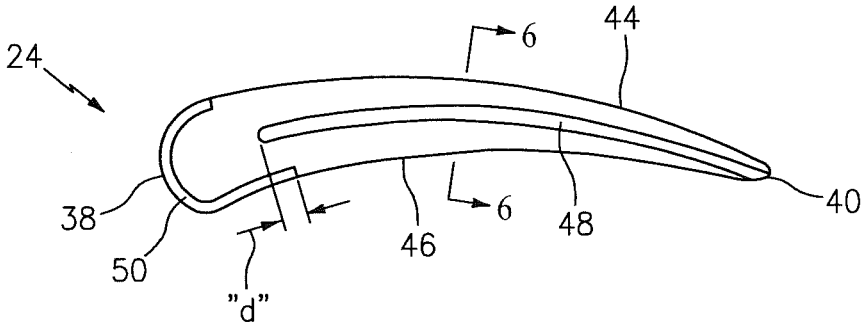
FIG. 5 is a diagrammatic top view of a blade tip and tip insert embodiment.

FIG. 1 illustrates a gas turbine engine 10 including a fan section 12, a low-pressure compressor section 14, a high-pressure compressor section 16, a combustor section 18, a high-pressure turbine section 20, and a low-pressure turbine section 22. Air drawn into the fan section 12 is directed into the compressor sections 14, 16 where it is worked to a higher pressure. The worked air subsequently passes through the combustor section 18 where fuel is added and ignited. The worked air and combustion products enter and power the turbine sections 20, 22 before exiting the engine.

The fan section 12 includes a plurality of fan blades 24 connected to, and radially extending out from, a fan hub 26. The blades 24 may be separable from the hub, or integrally formed with the hub. The fan section 12 is rotatable about centerline 28 of the engine. A containment case 30 is disposed radially outside of the fan section 12 and circumferentially surrounds the fan section 12. The containment case 30 includes an abradable blade outer air seal (BOAS).

FIGS. 2-5 illustrate embodiments of a present invention fan blade 24. In these embodiments, the fan blade 24 includes a root 32, an airfoil 34, and a blade tip insert 36. The root 32 is configured to engage the fan hub 26 (FIG. 1) in a manner that secures the fan blade 24 to the hub 26 (integrally formed blades do not include root sections, however). The airfoil 34 is defined by a leading edge 38, a trailing edge 40, a tip 42, a suction side surface 44 (see FIGS. 3-5), and a pressure side surface 46. The airfoil 34 includes a slot 48 disposed in the tip portion 42. The slot 48 extends in a chordwise direction between the leading edge 38 and the trailing edge 40 of the airfoil 34, and is disposed between the pressure side surface 46 and the suction side surface 44 for at least a portion of the airfoil 34. In the embodiment illustrated in FIG. 3, the slot 48 is disposed between the suction side and pressure side surfaces 44, 46, extending from the leading edge 38 to the trailing edge 40 of the airfoil 34. The slot 48 may, but is not required to, track directly along the chord line extending between the leading edge 38 and trailing edge 40. The slot 48 may also extend along a path that deviates from a chord; e.g., in the tip of an airfoil 34 having a narrow trailing edge region, the slot 48 may deviate from the chord line to break on the pressure side surface of the airfoil 34 (e.g., see FIG. 5) to avoid potential structural issues that would be associated with a slot break at a very narrow trailing edge.

In some embodiments (e.g., see FIGS. 4 and 5), the slot 48 extends only a portion of the distance between the leading edge 38 and the trailing edge of the airfoil 34. For example, each of the airfoil embodiments 34 shown in FIGS. 4 and 5 has a slot 48 that terminates prior to reaching the leading edge 38. In those embodiments, the airfoil leading edge 38 is formed by an insert 50 (referred to as "a leading edge insert") attached to the airfoil 34. The leading edge insert 50 can be configured to extend along a portion of the pressure side surface 46 of the airfoil 34; e.g., along a distance that permits the leading edge insert 50 and the tip insert 36 to collectively extend along the entire chordwise length of the fan blade tip 42. Alternatively, the leading edge insert 50 and the tip insert 36 can overlap with one another in a chordwise direction (e.g., the overlap is shown as distance "d" in FIG. 5).

Figure 9:
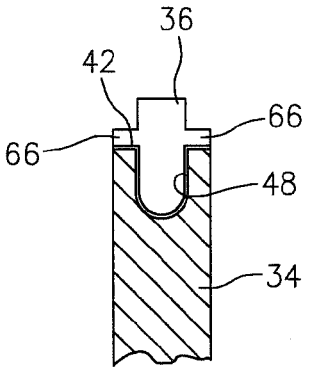
FIG. 9 is a diagrammatic partial section view of a blade tip portion and tip insert embodiment.
Figure 7:
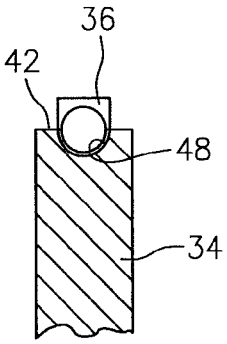
FIG. 7 is a diagrammatic partial section view of a blade tip portion and tip insert embodiment.
Figure 10:
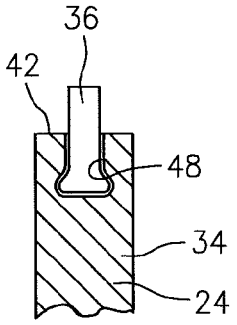
FIG. 10 is a diagrammatic partial section view of a blade tip portion and tip insert embodiment.
Figure 8:
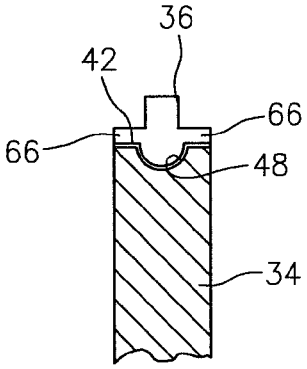
FIG. 8 is a diagrammatic partial section view of a blade tip portion and tip insert embodiment.

The slot 48 in the tip 42 of the fan blade 24 may have one of several cross-sectional geometries; e.g., FIGS. 6-10 illustrate several slot 48 cross-sectional geometry embodiments. The views shown in FIGS. 6-10 are all cut along a sectional line such as that depicted for section 6-6 in FIG. 5; i.e., a cross-sectional line perpendicular to the chordwise axis of the slot 48. The slot 48 shown in FIG. 6, for example has a rectangular cross-sectional. The slots 48 shown in FIGS. 7 and 8 each have a semi-circular (or at least partially semi-circular) cross-sectional geometry. The slot cross-sectional geometry shown in FIG. 9 is substantially U-shaped. The slot cross-sectional geometry shown in FIG. 10 is a geometry (e.g., a partial "dog-bone") wherein the tip insert 36 cannot be pulled radially from the slot 48. The various different slot cross-sectional geometries may each be described as having at least one interior surface (e.g., the rectangular cross-section slot 48 shown in FIG. 6 may be described as having three distinct interior surfaces 52*a*, 52*b*, 52*c*). The present invention blade 24 is not limited to any particular slot geometry. Slot cross-sectional geometries that avoid unfavorable stress concentration factors ($K_t$ values) may be used.

The present fan blade 24 may be fabricated from a variety of different materials, including aluminum, composite materials, and combinations of different materials. Aluminum is a favored material because it has a low mass-to-volume ratio, and acceptable mechanical strength. The present invention can be implemented on fan blades 24 having a solid airfoil, and others having an airfoil with one or more internal cavities (e.g., similar to the hollow fan blades disclosed in U.S. patent application Ser. No. 12/713,944).

Figure 11:
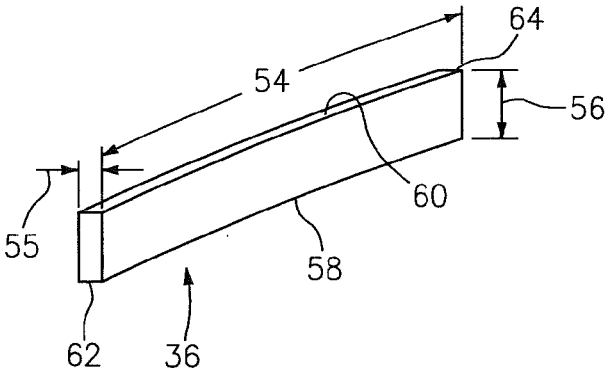
FIG. 11 is a diagrammatic perspective view of a tip insert embodiment.

Referring to FIG. 11, the tip insert 36 has a length 54, thickness 55, and a width 56, and extends widthwise between a base end 58 and a rub end 60. The base end 58 has a widthwise cross-sectional geometry that mates with the widthwise cross-sectional geometry of the blade tip slot 48 (e.g., widthwise cross-sections are diagrammatically shown in FIGS. 6-10). The tip insert 36 extends lengthwise between a forward end 62 and an aft end 64, and is shaped lengthwise to mate with the chordwise geometry of the slot 48 (e.g., straight, curved, etc). When the base end 58 of a tip insert 36 is inserted into a slot 48, the rub end 60 of the tip insert 36 extends radially outward from the airfoil 34; the rub end 60 of each tip insert 36 extends a radial distance outward from its respective blade tip 42 so as to be in close proximity of the abradable BOAS. In the embodiment shown in FIGS. 8 and 9, the tip insert 36 also includes a pair of support flanges 66 extending laterally outward. The support flanges 66 are configured to contact a top surface of the airfoil tip 42. The contact area provides additional support for the tip insert 36 and also additional surface between the tip insert 36 and the airfoil tip for attachment; e.g., bonding as will be explained below. The tip insert 36 may be integrally formed, or may include a plurality of components inserted into the slot 48.

The tip insert 36 is typically made of a material with greater durability than the material of the fan blade 24. Titanium is an example of an acceptable material. In preferred embodiments, the tip insert 36 is fabricated from a material that helps to reduce or eliminate galvanic corrosion of the fan blade 24. For example, if the fan blade 24 is made of aluminum, a tip insert 36 made of an anodized aluminum is acceptable because the anodized aluminum has greater durability that the aluminum alloy of the blade 24, and helps to reduce galvanic corrosion of the aluminum fan blade 24. A ceramic tip insert 36 would also avoid galvanic corrosion. The present invention tip inserts 36 are not limited to use with any particular material.

Figure 6:
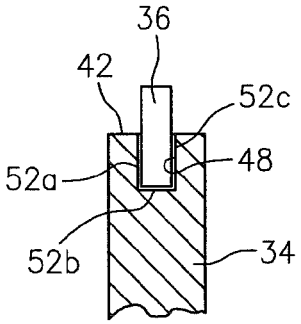
FIG. 6 is a diagrammatic partial section view of a blade tip portion and tip insert embodiment.

Referring to FIGS. 6-10, as indicated above, the base end of the tip insert 36 has a cross-sectional geometry that mates with the cross-sectional geometry of the blade tip slot 48. In FIG. 6, the tip insert base end has a rectangular cross-sectional. The tip inserts 36 shown in FIGS. 7 and 8 each have an arcuate base end cross-sectional geometry. Examples of arcuately shaped cross-sectional geometries include, but are not limited to, semi-circular, or at least partially semi-circular, geometries. The tip insert base end geometry shown in FIG. 9 is substantially U-shaped; e.g., a "U-shaped" cross-sectional geometry is at least partially arcuately shaped. The tip insert base end geometry shown in FIG. 10 is partially "dog-bone" shaped.

A tip insert 36 can be retained in a slot 48 by mechanical attachment (e.g., "dog-bone" male tip insert base end coupled with a mating female slot configuration—see FIG. 10), or by material attachment (e.g., weld, braze, etc.), or by bonding agent (e.g., EA 9394 epoxy paste manufactured by Henkel AG & Co. KGaA of Düsseldorf, Germany), or some combination thereof Alternatively, the blade tip 42 could be machined to have a male (or female) feature that mates with a corresponding female (or male) geometry disposed within the tip insert 36. Significant advantages of utilizing a slot 48 to receive the tip insert 36 include the mechanical attachment created by the slot 48 and the additional contiguous area between the slot 48 and the tip insert 36 that can be used for bonding area.

As a result of the present invention airfoil tip insert 36, rotary blades for use in gas turbine engines can be made sufficiently durable so as to prevent the blade tips from being damaged if they engage an abradable seal material and, therefore, the present invention airfoil tip insert 36 overcomes the problems previously discussed. In addition, it should be readily appreciated that although the present invention airfoil tip insert 36 and associated slot 48 have been described in the present Detailed Description of the Invention in the context of a fan blade 24 embodiment, the present invention is not limited to a fan blade application and may be applied to other gas turbine engine components; e.g., turbine blades, compressor blades, vanes, etc.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A rotary blade, comprising:

a root, an airfoil attached to the root, wherein the airfoil has a suction side surface, a pressure side surface, a leading edge, a trailing edge, a tip, and a slot disposed within the tip, and wherein the slot extends in a chordwise direction between the leading edge and trailing edge; and a tip insert having a base end and a rub end, the tip insert configured as a unitary and uninterrupted body;

wherein the base end of the tip insert is disposed within the slot, and the rub end of the tip insert extends radially outward from the airfoil tip;

wherein the tip insert and the airfoil are discretely formed bodies;

wherein the tip insert comprises metal and/or ceramic; and wherein the slot is disposed in the tip between the pressure side surface and the suction side surface of the airfoil; and wherein a portion of the slot extends to the pressure side surface of the rotary blade adjacent to the trailing edge of the blade.

2. The rotary blade of claim 1, wherein the slot extends all the way between the leading edge and the trailing edge.

3. The rotary blade of claim 1, further comprising a leading edge insert disposed at the leading edge of the rotary blade.

4. The rotary blade of claim 1, wherein the airfoil comprises aluminum, and the tip insert comprises anodized aluminum, titanium and/or ceramic.

5. The rotary blade of claim 1, wherein the slot is substantially rectangular-shaped.

6. The rotary blade of claim 1, wherein at least a portion of the slot is arcuately shaped.

7. The rotor blade of claim 1, wherein the tip insert is made of a material with a greater durability than a material from which the airfoil is made.

8. A rotary blade, comprising:

a root, an airfoil attached to the root, wherein the airfoil has a suction side surface, a pressure side surface, a leading edge, a trailing edge, a tip, and a slot disposed within the tip, and wherein the slot extends in a chordwise direction between the leading edge and trailing edge;

a tip insert having a base end and a rub end, the tip insert configured as a unitary and uninterrupted body; and a leading edge insert disposed at the leading edge of the rotary blade;

wherein the base end of the tip insert is disposed within the slot, and the rub end of the tip insert extends radially outward from the airfoil tip;

wherein the tip insert and the airfoil are discretely formed bodies;

wherein the tip insert comprises metal and/or ceramic; and wherein the leading edge insert extends chordwise along a first portion of the tip for a first distance, the tip insert extends chordwise along a second portion of the tip for a second distance, and a sum of the first distance and the second distance is equal to or greater than a chordlength of the airfoil tip.

9. A rotary blade tip insert for a rotary blade having an airfoil that has a suction side surface, a pressure side surface, a leading edge, a trailing edge, a tip, and a slot disposed within the tip, wherein the slot extends in a chordwise direction between the leading edge and trailing edge, the tip insert comprising:

a unitary and uninterrupted body having a width extending radially between an inner surface of a base end and an outer surface of a rub end, and a length extending between a forward end and an aft end;

wherein the base end is configured to be received within the slot and the rub end is configured to extend radially outward from the airfoil tip;

wherein the tip insert comprises metal and/or ceramic;

wherein the tip insert is at least one of welded or brazed to the airfoil;

wherein the slot is disposed in the tip between the pressure side surface and the suction side surface; and wherein a portion of the slot extends to the pressure side surface adjacent to the trailing edge.

10. The rotary blade tip insert of claim 9, wherein the length of the tip insert is substantially equal to the chordwise distance between the leading edge and the trailing edge of the airfoil.

11. The rotary blade tip insert of claim 9, wherein the tip insert comprises anodized aluminum, titanium and/or ceramic.

12. The rotary blade tip insert of claim 9, wherein a widthwise cross-section of the tip insert is substantially rectangular-shaped.

13. The rotary blade tip insert of claim 9, wherein at least a portion of a width-wise cross-section of the tip insert is arcuately shaped.

14. A rotary blade assembly within a gas turbine engine, the assembly comprising:

a plurality of rotary blades extending radially outwardly from a hub, each of the rotor blades having a tip insert and an airfoil that has a suction side surface, a pressure side surface, a leading edge, a trailing edge, a tip, and a slot disposed within the tip, wherein the slot extends in a chordwise direction between the leading edge and trailing edge, wherein the tip insert has a base end and a rub end, and wherein the base end of the tip insert is disposed within the slot, and the rub end of the tip insert extends radially outward from the airfoil tip; and a containment case disposed radially outside of the rotary blades and circumferentially surrounding the plurality of blades, wherein the containment case includes an abradable blade outer air seal;

wherein the tip insert and the airfoil are discretely formed bodies;

wherein the tip insert comprises metal and/or ceramic, and the tip insert is configured as an integrally formed body;

wherein the tip insert is at least one of welded or brazed to the airfoil;

wherein the slot is disposed in the tip between the pressure side surface and the suction side surface; and wherein a portion of the slot extends to the pressure side surface adjacent to the trailing edge.

15. The rotary blade assembly of claim 14, wherein the plurality of rotary blades are fan blades.

16. The rotary blade assembly of claim 14, wherein the airfoil comprises aluminum, and the tip insert comprises anodized aluminum, titanium and/or ceramic.

17. The rotary blade assembly of claim 14, wherein the slot in each of the plurality of rotary blades is at least partially arcuately shaped.

18. The rotary blade assembly of claim 14, wherein the plurality of rotary blades are compressor blades.

19. The rotary blade assembly of claim 14, wherein the plurality of rotary blades are turbine blades.

* * * * *